US005105871A

United States Patent [19]

Baud et al.

[11] Patent Number: 5,105,871

[45] Date of Patent: Apr. 21, 1992

[54] TUBULAR MOTOR WINDING DEVICE FOR BLINDS, ROLLER SHUTTERS OR THE LIKE

[75] Inventors: André Baud, Ville La Grand; Claude Y. R. Brichaux, Annemasse, both of France; Rolf E. Haering, Moessingen, Fed. Rep. of Germany

[73] Assignee: Somfy, Cluses, France

[21] Appl. No.: 757,554

[22] Filed: Sep. 11, 1991

[30] Foreign Application Priority Data

Sep. 17, 1990 [FR] France ..... 90 11461

[51] Int. Cl.[5] ..... E06B 9/56

[52] U.S. Cl. ..... 160/310; 160/323.1; 403/353; 403/326

[58] Field of Search ..... 160/310, 323.1, 325, 160/326; 403/359, 353, 326

[56] References Cited

U.S. PATENT DOCUMENTS 4,665,965 5/1987 Pasquier et al. ..... 160/310
5,044,417 9/1991 Bresson ..... 160/310

FOREIGN PATENT DOCUMENTS 1245064 7/1967 Fed. Rep. of Germany ..... 160/310
328397 5/1930 United Kingdom ..... 160/310

*Primary Examiner*—Blair M. Johnson
*Attorney, Agent, or Firm*—Laff, Whitesel, Conte & Saret

[57] ABSTRACT

A winding device comprising a winding tube inside which is housed a tubular motor whose profiled output shaft is fitted into a profiled hole in a transverse member fastened to the winding tube, in such a manner that the output shaft is fixed in respect of rotation with said transverse member. The profiles permit interengagement in at least two different angular positions. The output shaft has at least one resiliently retractable hook. The transverse member has at least one hooking point and a number of release passages at least equal to the number of hooks, the dimension of the release passages being such that the hook engaged in a release passage is inoperative, the hook being designed to hook automatically on a hooking point in at least one interengagement position. The positions of the hooks and release passages may be reversed.

Depending on the tube in which the motor is mounted, its output shaft may or may not be axially fastened to the drive disk.

5 Claims, 3 Drawing Sheets

FIG. 8
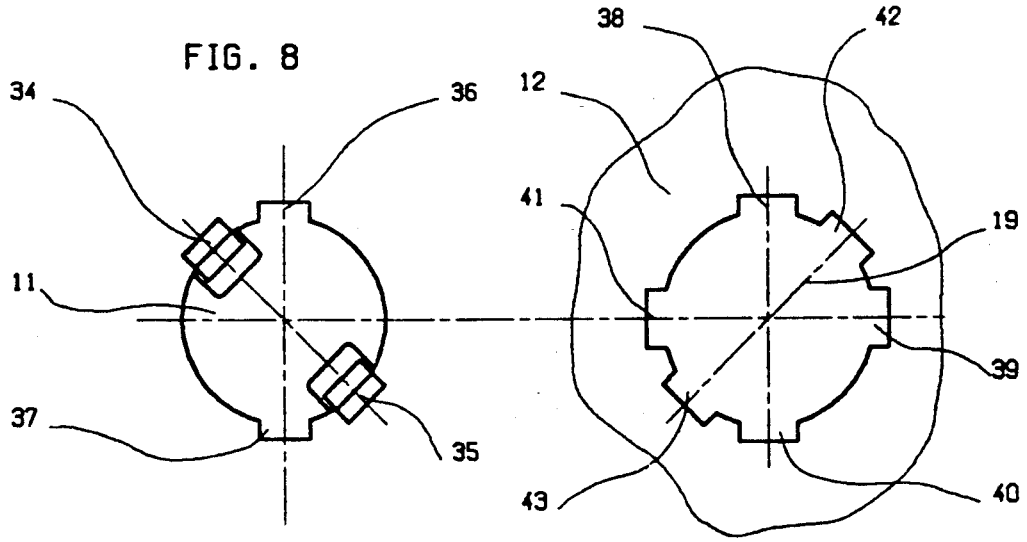
FIG. 9
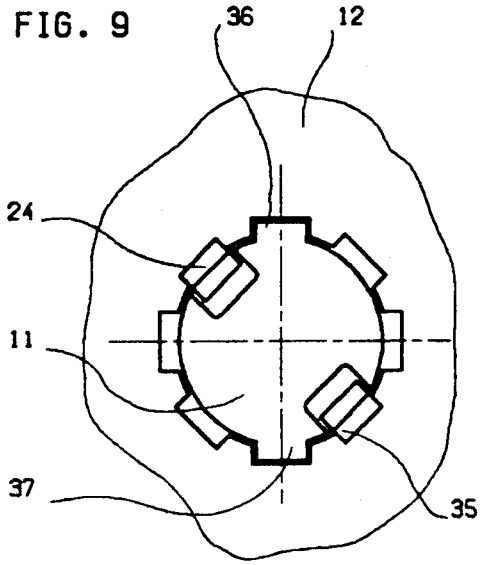
FIG. 10
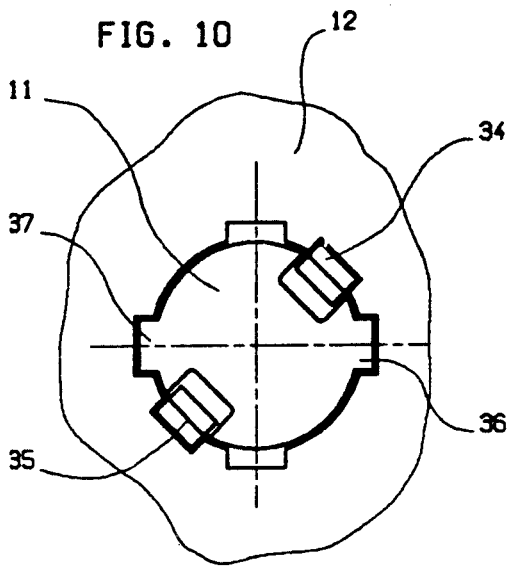
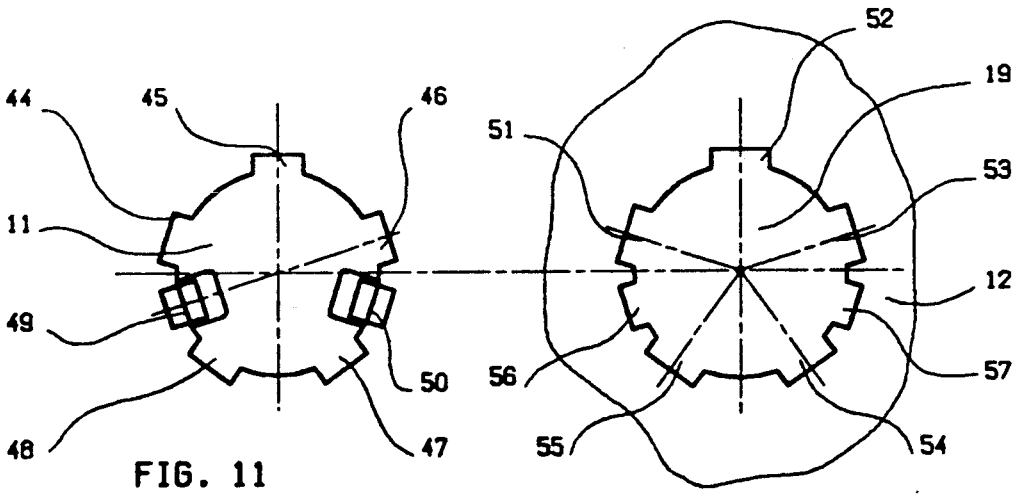
FIG. 11

TUBULAR MOTOR WINDING DEVICE FOR BLINDS, ROLLER SHUTTERS OR THE LIKE

FIELD OF THE INVENTION

The invention relates to a device for winding blinds, roller shutters or the like, comprising a winding tube inside which is housed a tubular motor whose profiled output shaft is fitted into a profiled hole in a transverse member fastened to the winding tube, in such a manner that the output shaft is fixed in respect of rotation with said transverse member, the profiles being such that they permit interengagement in at least two different relative angular positions.

PRIOR ART

In known winding devices said transverse member generally consists of a circular or polygonal disk fastened to the winding tube either by an auxiliary component or directly by its polygonal profile in cases where the winding tube is itself of polygonal section. In the case of a tube having a circular section, the drive disk must be locked in the tube in order to be able to effect the driving, but it must also remain free in respect of translation on the output shaft of the tubular motor, or more precisely of the motor-reduction gear unit, in order to facilitate the subsequent removal of the latter, particularly when the tube is surrounded by the windable element. In the case of a winding tube of polygonal section, the drive disk can remain free in respect of translation in the tube, but it must then be secured in respect of translation on the output shaft of the motor-reduction gear unit. Consequently, depending on the tube in which the motor-reduction gear unit is mounted, its output shaft must, or must not, be provided with means holding the drive disk on said output shaft. Such means consist for example of a clip or a washer held by an axial screw (French patent 1 373 351). The installer must then always be provided with these auxiliary fastening means so as to be able to use them when required.

SUMMARY OF THE INVENTION

The object of the present invention is to obtain, or not to obtain, the axial fastening of the drive disk and the motor output shaft without auxiliary fastening means and without intervening on the motor output shaft or on the transverse member fastened to the winding tube, that is to say the drive disk.

To this end the winding device according to the invention is defined in that one of the interengaging members, that is to say the output shaft or the transverse member, has at least one resiliently retractable hook, and that the other member has at least one hooking point and a number of release passages at least equal to the number of hooks, the dimension of the release passage being such that the hook engaged therein is inoperative, the hook being designed to hook automatically on the hooking point on interengagement of the two parts in at least one angular interengagement position, in such a manner that the output shaft and said member fastened to the winding tube are axially fastened to one another, and to engage in a release passage in at least one angular interengagement position, the output shaft and said transverse member not being axially fastened to one another in that position.

BRIEF DESCRIPTION OF THE DRAWINGS

The invention will be better understood from the description of some examples of embodiment, which is given with reference to the accompanying drawing, in which:

FIG. 8 shows side by side the profiles of the output shaft and of the hole in the transverse member in a fourth embodiment;

FIG. 9 shows this fourth embodiment in a first position of engagement of the shaft;

FIG. 10 shows the same embodiment in another position of engagement of the shaft;

FIG. 11 shows side by side the profile of the shaft and the profile of the hole in the transverse member in a fifth embodiment.

DESCRIPTION OF THE PREFERRED EMBODIMENTS

Figure 1:
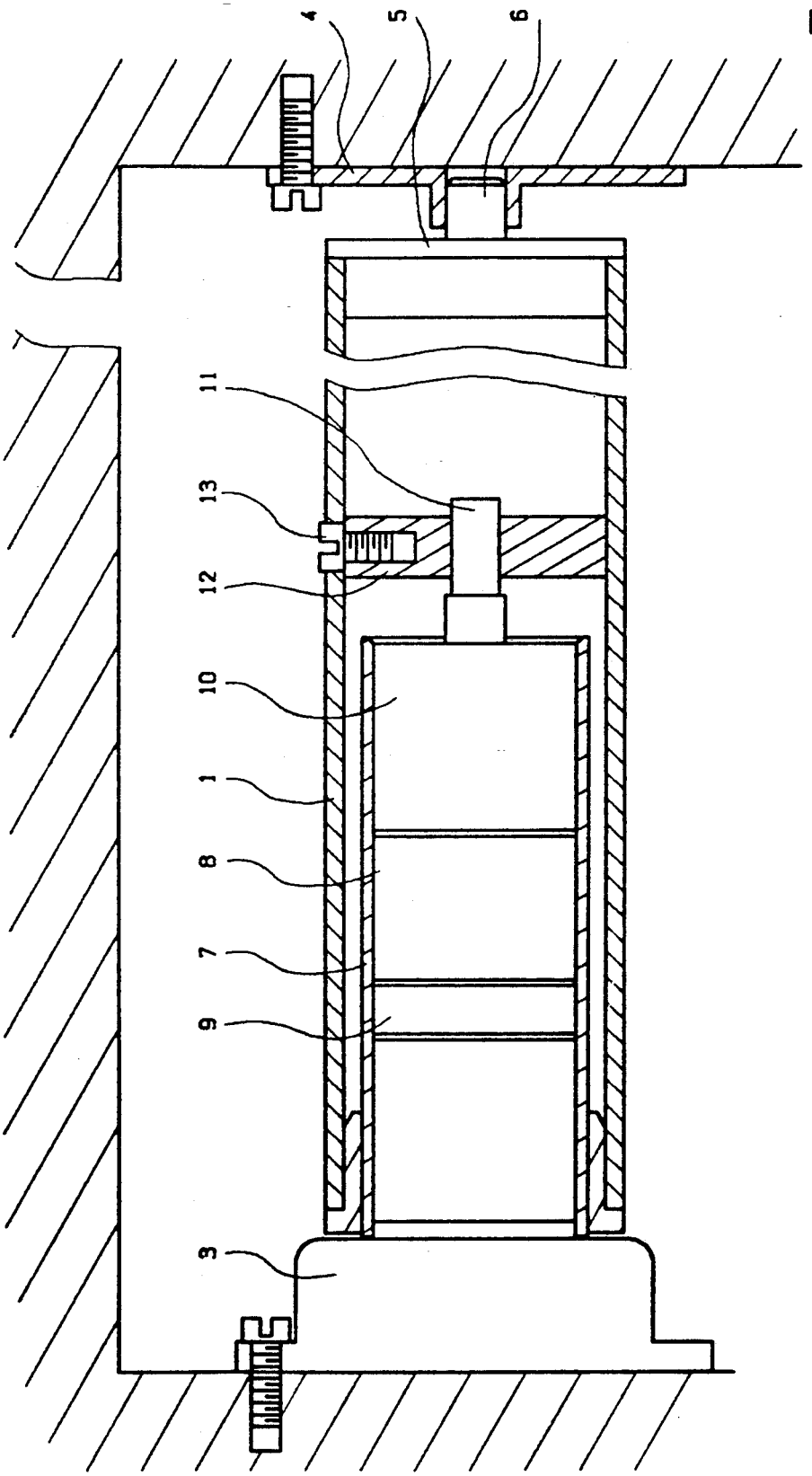
FIG. 1 is a schematic view in axial section of a winding device.

FIG. 1 shows schematically a winding device of known design, comprising a winding tube 1 on which is wound a roller blind, a roller shutter or the like. This winding tube is mounted, for example, in a window opening between a fixed casing 3 and a plate 4 in which an end plate 5 of the winding tube is mounted for rotation by means of a pin 6. Inside and concentrically to the winding tube 1 is disposed a tubular casing 7 fastened to the fixed casing 3 and containing an electric motor 8 supplied through a connector 9 and driving a reduction gear unit 10, whose output shaft 11 drives the winding tube 1 with the aid of a transverse member fastened to the winding tube and comprising, in this particular instance, a disk 12 fixed to the winding tube 1 by means of a screw 13.

The end part of the output shaft 11 has, for example, one of the shapes shown in FIGS. 2 to 11. For the sake of simplification the output shaft will always be given the reference 11 and the drive disk the reference 12.

Figure 2:
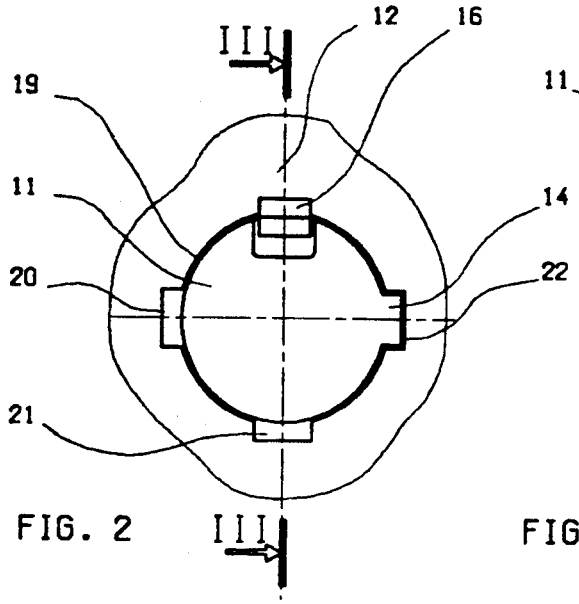
FIG. 2 is an axial view of a first embodiment of the output shaft and of a part of the transverse drive member.
Figure 3:
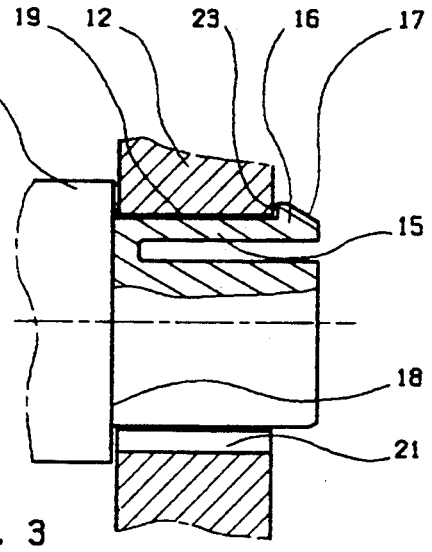
FIG. 3 is a view in section along the line III—III in FIG. 2.

In a first embodiment shown in FIGS. 2 and 3 the output shaft 11 has on the one hand a longitudinal rib 14 and on the other hand, at 90° to said rib, a longitudinal tongue 15 ending in a hook 16 provided on outside with a sloping surface 17. At the rear of the tongue 15 and of the rib 14 the output shaft 11 has a supporting surface 18. The distance between said supporting surface 18 and the hook 16 is very slightly greater than the thickness of the disk 12. Said disk 12 is provided with a hole 19 of circular general shape, in which is engaged the end part of the output shaft 11. This hole 19 is provided with three grooves 20, 21 and 22 of rectangular profile, two of which are disposed diametrically opposite, while the third groove 21 is situated at 90° to the other two grooves.

When the output shaft 11 is engaged in the hole 19 in the disk 12 in the relative angular position shown for these two parts, the sloping surface 17 of the hook 16 enables the latter to retract into the hole 19, causing the tongue 15 to bend. After passing through the hole 19, the hook 16 relaxes and is automatically hooked over the other face of the disk 12. The rib 14 has engaged freely in the groove 22. The output shaft 11 and the disk 12 are thus fixed together in respect of rotation by the rib 14 and the groove 22, and in respect of translation by the hook 16.

If, on the other hand, before the output shaft 11 is engaged in the hole 19, said shaft is turned through 90° or 180° about its axis, in the clockwise direction in the drawing, or through 180° or 270° in the counterclockwise direction, the hook 16 will engage freely in one of the grooves 20, 21 or 22, which then acts as a release passage for said hook, while the rib 14 engages in one or the other of the other grooves 20 or 21. The hook 16 is then inoperative and the disk 12 is not fastened axially on the output shaft 11. The point 23 on the circumference of the edge of the hole 19 thus constitutes a hooking point for the hook 16.

Figure 4:
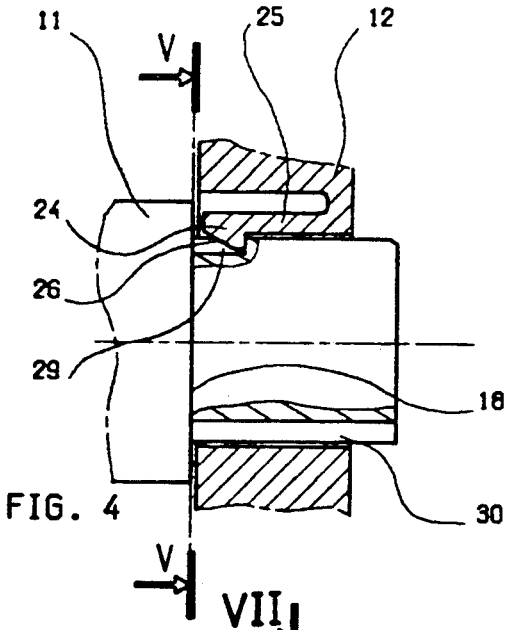
FIG. 4 is a view in axial section of the output shaft in a second embodiment.
Figure 5:
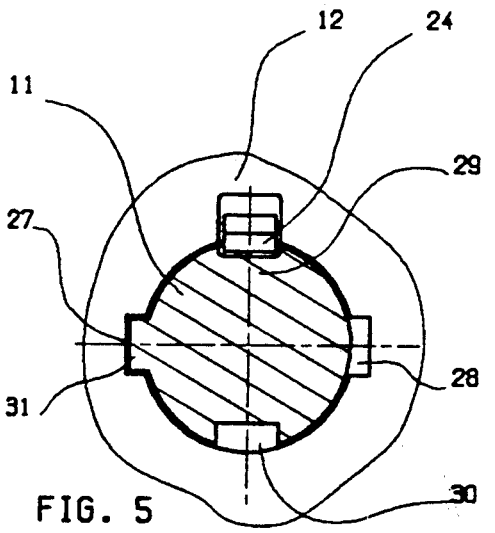
FIG. 5 is a view in section along the line V—V in FIG. 4.

It is possible to form the hook on the disk 12 and the release passage on the output shaft 11. One example of construction is illustrated in FIGS. 4 and 5. The disk 12 is provided with a hook 24 formed at the end of a resilient tongue 25 directed parallel to the axis of the hole 19. Said hook 24 is likewise provided with an engagement slope 26. The hole in the disk 12 also has two diametrically opposite grooves 27 and 28. The end part of the output shaft 11 has a notch 29 close to the support surface 18, a groove 30 diametrically opposite the notch 29, and a rib 31 situated at 90° to the notch 29 and the groove 30. In the position shown in the drawing the output shaft 11 has been introduced into the hole in the disk 12 in such a manner that the hook 24, at first retracted resiliently, has relaxed and hooked itself into the notch 29, while the rib 31 has engaged in the groove 27. The output shaft 11 and the disk 12 are thus fixed together in respect of rotation and of translation.

If before being introduced into the disk 12 the output shaft 11 is turned through 180° about its axis, relative to the disk 12, in order to introduce its rib 31 into the other groove 28 in the disk 12, the groove 30 in the shaft will face the hook 24, which can freely engage in the release passage constituted by said groove 30. The output shaft 11 and the disk 12 are then fixed together only in respect of rotation. This embodiment is further distinguished from the first embodiment described in that the output shaft 11 and the disk 12 can occupy only two different angular positions.

Figure 6:
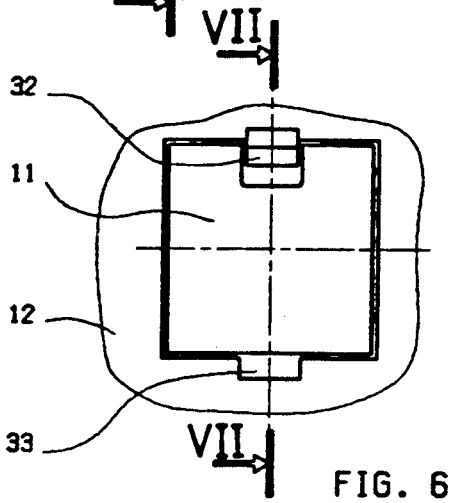
FIG. 6 is an axial view of the output shaft and drive member in a third embodiment.
Figure 7:
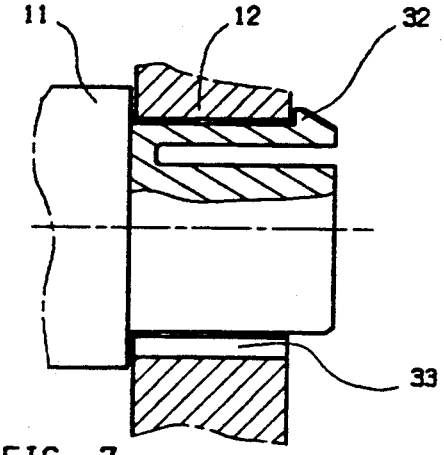
FIG. 7 is a view in section along the line VII—VII in FIG. 6.

Fixed in respect of rotation can of course be achieved with the aid of polygonal profiles, for example a square profile, as shown in FIGS. 6 and 7. In this example it is the output shaft that is provided with a resiliently retractable hook 32 similar to the hook 16 in the first embodiment. The square hole in the disk 12 has only a single release passage formed by a groove 33. The output shaft 11 can occupy four different angular positions relative to the disk 12, the shaft and the disk being fixed together in respect of rotation and translation in three of these positions, and in respect of rotation only in only one of these positions.

FIGS. 8 to 11 illustrate other embodiments utilizing a cylindrical basic shape.

The embodiment illustrated in FIG. 8 is a variant of the first embodiment. The output shaft 11 is provided with two diametrically opposite resilient hooks 34 and 35 similar to the hook 16, and with two diametrically opposite ribs 36 and 37 similar to the rib 14. The arc between each of the hooks 34 and 35 and the nearest rib is equal to 45°. The hole 19 in the disk 12 is provided with four drive grooves 38, 39, 40 and 41 disposed in diametrically opposite pairs, the diameters being at right angles to one another. The hole 19 has in addition two release grooves 42 and 43 disposed diametrically opposite and situated midway between two drive grooves.

FIG. 9 shows a first position of engagement of the output shaft 11 in the disk 12, in which position the hooks 34 and 35 are hooked onto the disk 12 and the ribs 36 and 37 are engaged in two drive grooves in the disk 12.

FIG. 10 shows another angular position of engagement in which the hooks 34 and 35 are engaged in the release grooves 42 and 43 in the disk 12, and consequently are inoperative, the ribs 36 and 37 being engaged in two other drive grooves.

FIG. 11 shows a fifth embodiment in which the output shaft 11 is provided with five ribs 44 to 48 distributed regularly over the circumference of the shaft, and two retractable hooks 49 and 50 situated on one and the same half of the circumference, midway between two ribs. The hole 19 in the disk 12 has five grooves 51 to 55 distributed regularly over the circumference of the hole and intended to cooperate with the ribs 44 to 48 in one of five possible angular positions. The hole 19 also has two release grooves 56 and 57 occupying, relative to the other grooves, the same position as the hooks 49 and 50 relative to the ribs. In a single relative angular position of the output shaft 11 and the disk 12 the hooks 49 and 50 are both situated in a release groove. In all the other angular positions at least one of the hooks 49 and 50 is operative. In certain positions a single hook is operative, whereas in other positions both hooks are operative.

From the different examples described it is clear that the release grooves may be formed by the grooves for rotational driving (FIGS. 1 and 2) or by special grooves (FIGS. 4 to 11).

In the case of the embodiments shown in FIGS. 6 to 11 the hooks may of course be provided on the disk 12, as in the second embodiment. Hybrid solutions are obviously possible in principle, wherein the output shaft and the disk could both have at least one retractable hook.

It can be seen that there is a wide choice in the number of possible positions and, among these, in the number of axially locked positions.

We claim:

1. A device for winding blinds, roller shutters or the like, comprising a winding tube inside which is housed a tubular motor whose profiled output shaft is fitted into a profiled hole in a transverse member fastened to the winding tube, in such a manner that the output shaft is fixed in respect of rotation with said transverse member, the profiles being such that they permit interengagement in at least two different relative angular positions, wherein one of the interengaging members, that is to say the output shaft or the transverse member has at least one resiliently retractable hook, and that the other member has at least one hooking point and a number of release passages at least equal to the number of hooks, the dimension of the release passages being such that the hook engaged in a release passage is inoperative, the hook being designed to hook automatically on a hooking point on interengagement of the two parts in at least one angular interengagement position, in such a manner that the output shaft and said transverse member are axially fastened to one another, and to engage in a release passage in at least one certain angular interengagement position, the output shaft and said transverse member not being axially fastened to one another in that position.

2. A device as claimed in claim 1, wherein the hooking point is situated on the output shaft and consists of a notch.

3. A device as claimed in claim 1, wherein the output shaft and the profiled hole of said transverse member have a cylindrical general shape, their fixing in respect of rotation being achieved by means of ribs and grooves and said release by means of release grooves.

4. A device as claimed in claim 3, wherein the release grooves are the same as the grooves for fixing in respect of rotation.

5. A device as claimed in claim 3, wherein the release grooves are grooves different from the grooves for fixing in respect of rotation.

* * * * *